United States Patent [19]

Mealing et al.

[11] 4,273,497

[45] Jun. 16, 1981

[54] REFUSE STORAGE AND DISCHARGE APPARATUS

[75] Inventors: Barrie E. Mealing; Roderick A. Scott, both of Warwick, England

[73] Assignee: Hestair Eagle Limited, Warwick, England

[21] Appl. No.: 48,314

[22] Filed: Jun. 13, 1979

[30] Foreign Application Priority Data

Jun. 26, 1978 [GB] United Kingdom ..... 27914/78

[51] Int. Cl.[3] ..... B65F 3/28

[52] U.S. Cl. ..... 414/517; 414/509

[58] Field of Search ..... 414/509, 511, 517; 100/214

[56] References Cited

U.S. PATENT DOCUMENTS

| | | | |
|---|---|---|---|
| 3,212,656 | 10/1965 | Kamin | 414/517 X |
| 3,815,764 | 6/1974 | Gillfillan et al. | 414/517 X |
| 3,896,947 | 7/1975 | Pearce | 414/517 |
| 3,901,394 | 8/1975 | Bowles | 414/511 |
| 3,953,170 | 4/1976 | Webb | 414/517 |
| 4,044,899 | 8/1977 | Booker | 414/517 |
| 4,050,594 | 9/1977 | Gollnick | 414/517 |
| 4,173,424 | 11/1979 | Whitehead et al. | 414/517 |

FOREIGN PATENT DOCUMENTS

| | | | |
|---|---|---|---|
| 1368299 | 2/1973 | United Kingdom | 414/517 |

*Primary Examiner*—Leslie J. Paperner
*Assistant Examiner*—Terrance L. Siemens
*Attorney, Agent, or Firm*—Pollock, Vande Sande and Priddy

[57] ABSTRACT

Rear discharge refuse collecting vehicle has a refuse container packed, for example, by a hydraulic packer mechanism in a pivotally mounted tailgate. A refuse pushing member is mounted for sliding movement by an inclined hydraulic refuse pushing ram to push refuse out of the container under the raised tailgate. The refuse pushing ram acts between the refuse pushing member and a short upstanding hollow fabricated steel cantilever just behind the vehicle cab at the front of the container. The cantilever is mounted on a support frame under the refuse container, and extends into a recess defined by a rearwardly sloping lower portion of the refuse pushing member whereby the cantilever occupies no space which would have been available for refuse, and the refuse pushing member can be fully retracted to the front of the refuse container and the container itself is not stressed by the ram.

4 Claims, 20 Drawing Figures

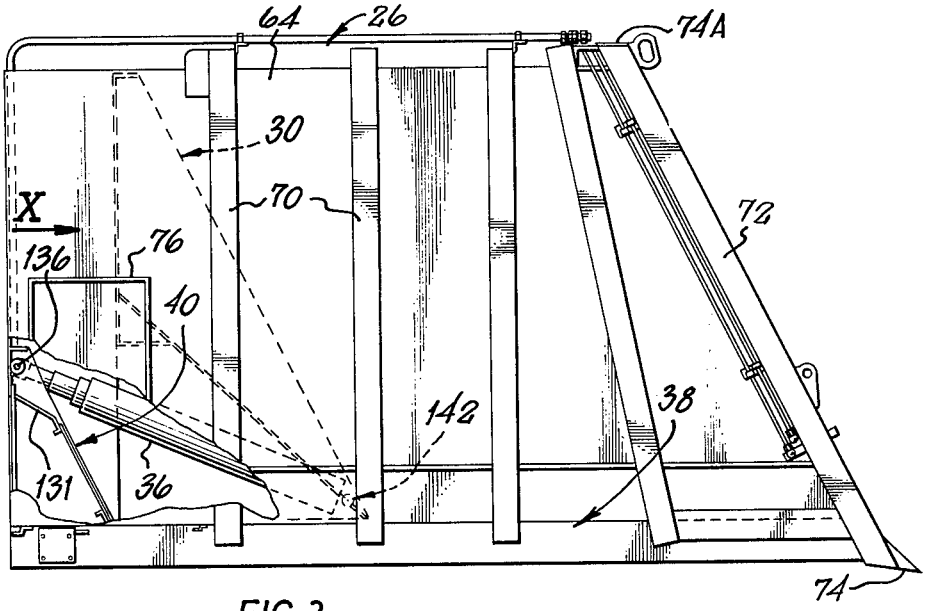
FIG. 3
FIG. 5
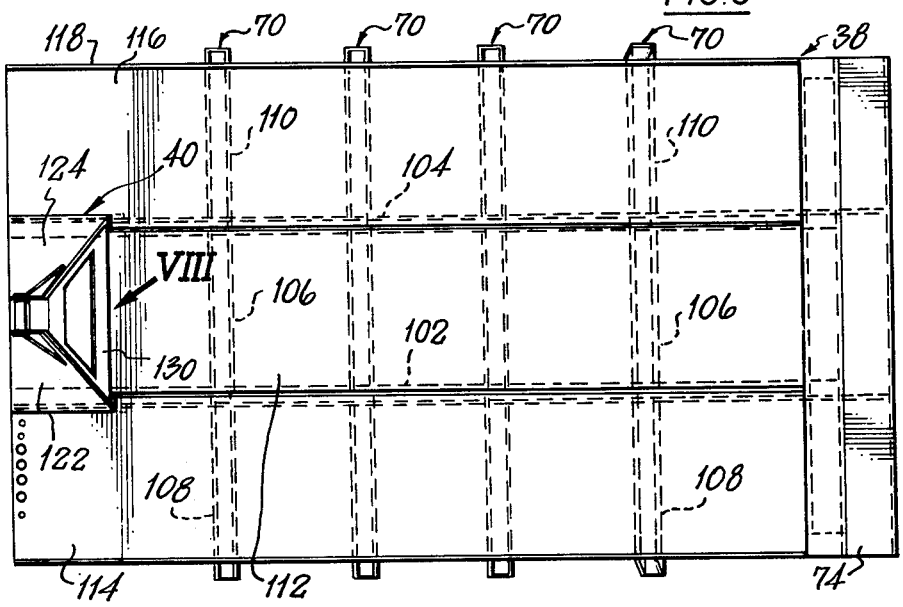

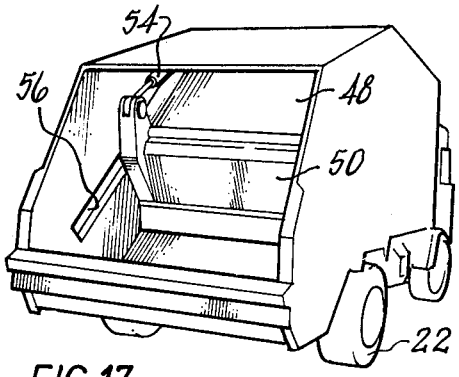
FIG.17
FIG.18
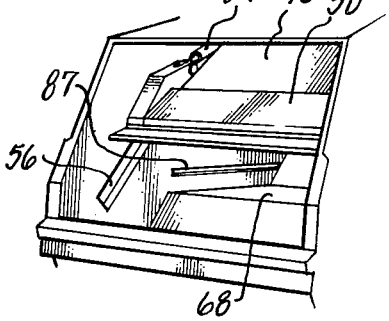
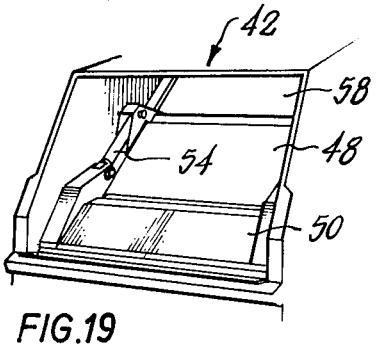
FIG.19
FIG.20
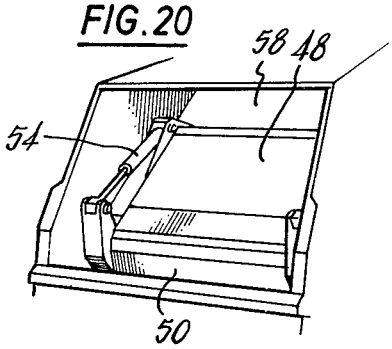
FIG. 8
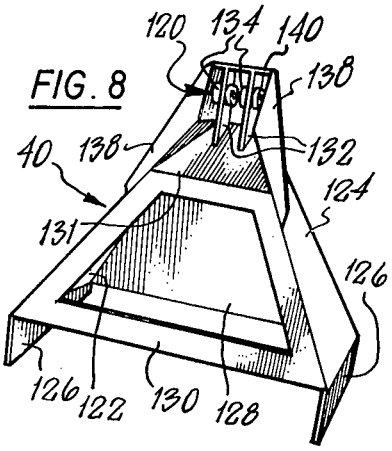
FIG. 10
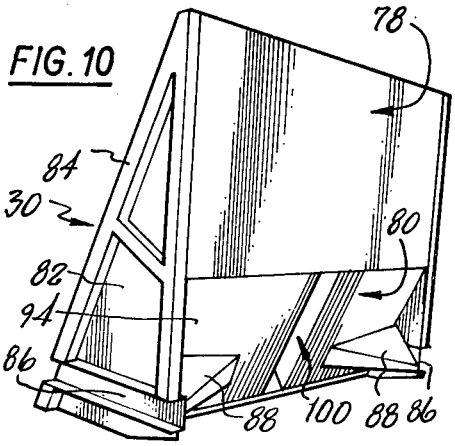

REFUSE STORAGE AND DISCHARGE APPARATUS

FIG. 1 of the drawings is the single Figure which best shows all features of the invention.

BACKGROUND TO THE INVENTION

This invention relates to refuse or garbage storage and discharge apparatus, for example to such apparatus adapted to be mounted on a self propelled road vehicle chassis to form a mobile rear discharge refuse collecting vehicle of the kind used for door-to-door collection of refuse from dustbins.

More specifically, the invention relates to refuse storage and discharge apparatus having a refuse container, and a refuse pushing member mounted in the container for movement lengthwise of the container by means of a hydraulic refuse pushing ram to discharge refuse when desired.

A more specific example of a vehicle in which such refuse storage and discharge apparatus could be incorporated is a self-propelled non-articulated truck constructed for rear loading of refuse into a refuse container through a tailgate having a hydraulically operated packing mechanism to pack the refuse into the container. The tailgate is pivotally mounted on the refuse container and can be raised by hydraulic lift rams when desired, to allow discharge of refuse.

A problem which has arisen in the design of such refuse storage and discharge apparatus lies in the arrangement of the hydraulic refuse pushing ram in relation to the refuse pushing member, and the structure provided to resist the large reaction thrust of the ram when it is extended and caused to eject a large mass of compacted refuse from within the container.

Prior proposals on the subject in most cases have the hydraulic ram acting between a front end wall of the refuse container and the refuse pushing member. Where a horizontal ram has been proposed it has usually been necessary, on account of the length of the ram, for the ram to protrude through the refuse pushing member into the refuse containing part of the container on the rear side of the refuse pushing member. This, in turn, has required the provision of a nose cone to shield the rear end of the ram and its connection to the refuse pushing member. The nose cone is itself undesirable because it changes the profile of the refuse pushing member and refuse sometimes becomes lodged on it and is not discharged when the refuse pushing ram is fully-extended—which can have safety implications if operators are tempted to clear away such lodged material under a raised tailgate. To avoid the provision of a nose cone it has been proposed to mount the hydraulic refuse pushing ram in a non horizontal attitude so as to accommodate the length of the ram. However, although this arrangement is preferable in that it allows the provision of an efficient profile on the refuse pushing member, there has remained the problem of providing structure at the non-discharge end of the refuse container strong enough to withstand the large reaction thrust generated by the refuse pushing ram and applied at a position well above the container floor. This problem has been met by providing an immensely strong reinforced wall at the non-discharge end of the container, or by providing one or more heavy bridging beams extending vertically or horizontally between the side walls or between the top and bottom walls of the container and connecting the ram directly to these beams. The refuse container has thus become undesirably heavy and expensive.

In addition, the reinforced container wall or bridging beams prevent complete return movement of the refuse pushing member to the non discharge end of the container, thereby reducing significantly the effective volume of the refuse container. This has serious implications for vehicle payload in relation to the use of the apparatus on a road vehicle chassis of a given length.

A general objective of the present invention is to provide refuse storage and discharge apparatus having an improved structure for the transmission of forces arising from actuation of a refuse pushing ram to move a refuse pushing member lengthwise of a refuse container to discharge refuse. More specific objects include the provision of a load carrying structure for said forces outside the refuse container whereby forces applied to the container are minimized and whereby return movement of the material pushing member to the non discharge end of the container is not obstructed so as to maximize the refuse carrying capacity of the apparatus for a given container length, without resorting to the use of a complex shape for the refuse pushing member.

BRIEF SUMMARY OF THE INVENTION

The invention provides refuse storage and discharge apparatus having a refuse container and a refuse pushing member mounted in the refuse container for movement back and forth therein by means of a hydraulic refuse pushing ram to discharge refuse when desired. A support frame is positioned below the container and extends lengthwise of the container and a cantilever is secured to the support frame at the non-discharge end of the refuse container. The cantilever extends upwards from the support frame and forms a rigid load—resisting structure therewith. The refuse pushing member has a lower portion sloping downwards and towards the discharge end of the refuse container, and said lower portion is constructed and arranged so as to overlie at least part of the cantilever when the refuse pushing member is at the non-discharge end of the refuse container so that the cantilever does not obstruct movement of the refuse pushing member to a fully retracted position at the non-discharge end of the refuse container. The hydraulic refuse pushing ram is connected between the upper end of the cantilever and the lower portion of the refuse pushing member so as to extend downwardly from the cantilever and towards the discharge end of the refuse container, thereby accommodating the length of the ram without the need for a nose cone on the refuse pushing member. The position of the connection between the ram and the cantilever is not higher than halfway between the top and the bottom of the refuse pushing member, thereby maximizing the usable refuse storage space provided by retraction of the refuse pushing member to its position overlying the cantilever.

BRIEF DESCRIPTION OF THE DRAWINGS

An embodiment of the invention will now be described by way of example with reference to the accompanying drawings in which:

FIG. 3 shows a side elevation view of a refuse container also seen in FIG. 1, but with the container partly cut away and showing certain details not seen in FIG. 1;

FIG. 5 shows a plan view (arrow V) of the assembly of FIG. 4;

FIG. 8 shows a rear perspective view (arrow VIII) of the cantilever seen in FIG. 5;

FIG. 10 shows a front perspective view (arrow X) of a refuse pushing member indicated in FIG. 3;

FIGS. 17 to 20 show perspective views of the rear of the vehicle illustrating the relative dispositions of the parts of the packer mechanism in the stages shown in FIGS. 12 to 15 respectively.

DESCRIPTION OF THE PREFERRED EMBODIMENTS

Figure 1:
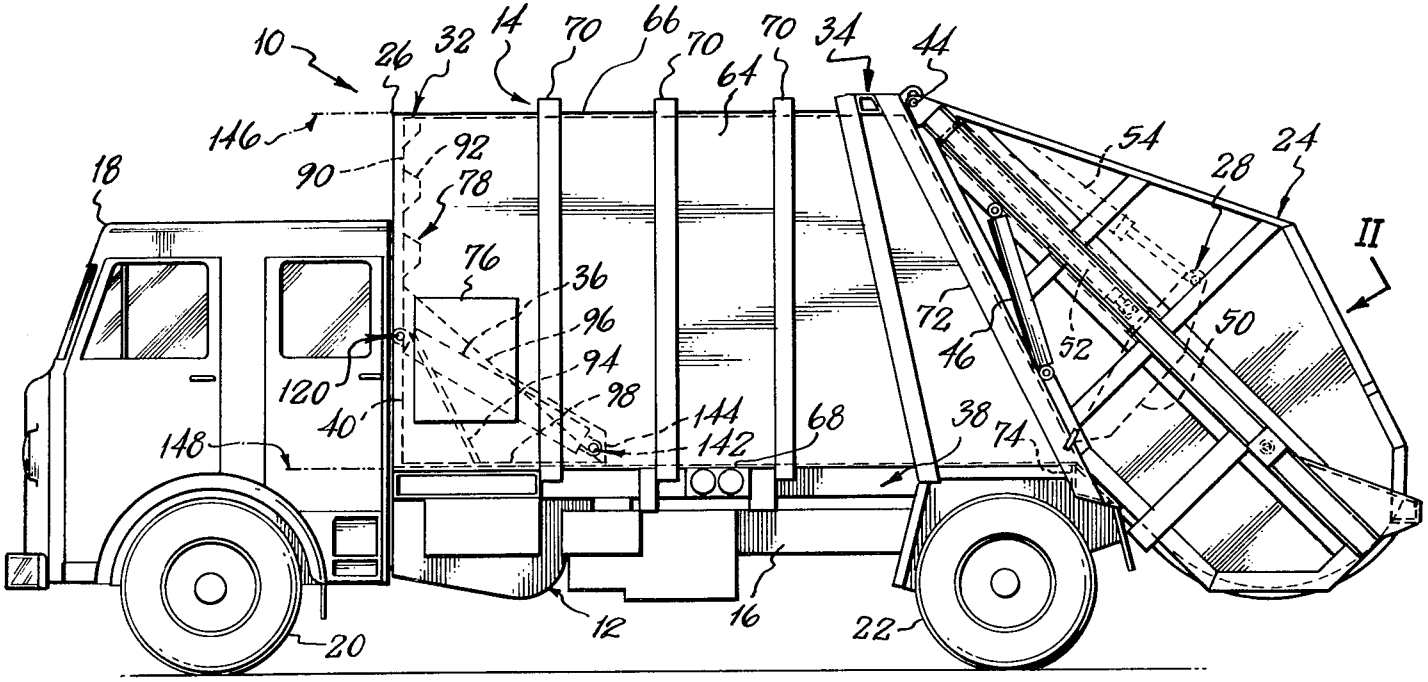
FIG. 1 shows a side elevation view of a refuse collecting vehicle.

As shown in the drawings, a rear discharge refuse collection vehicle 10 comprises a self-propelled non-articulated road vehicle chassis 12 having mounted thereon refuse storage and discharge apparatus 14.

Vehicle chassis 12 has its own vehicle support frame 16 carrying a driver's cab 18 housing a diesel engine (not shown), the vehicle support frame being mounted on steerable front wheels 20 and driven rear wheels 22.

The refuse storage and discharge apparatus 14 comprises:

- a tailgate 24 to receive refuse;
- a refuse container 26;
- a hydraulically operated packing mechanism 28 in the tailgate to pack refuse into container 26;
- an upright refuse pushing member 30 mounted in container 26 for movement lengthwise of the container between a non discharge end 32 thereof and a discharge end 34 to push refuse out of the container;
- a hydraulic refuse pushing ram 36 to actuate refuse pushing member 30; and
- a support frame 38 and an associated cantilever 40 connected to the forward end of ram 36 to resist the reaction thrust generated when ram 36 is extended.

These principal parts will now be described in more detail.

Figure 2:
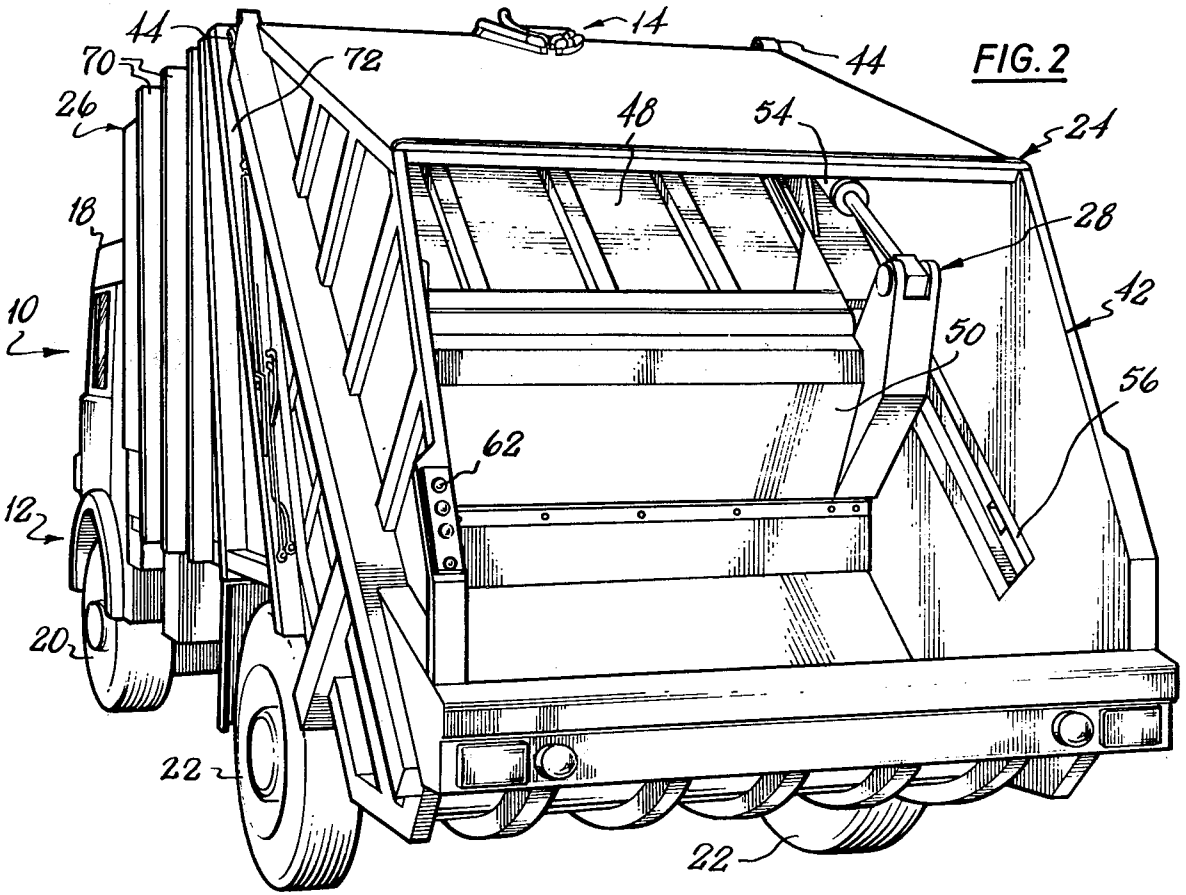
FIG. 2 shows a perspective rear elevation view of the vehicle of FIG. 1 (see arrow II in FIG. 1)
Figure 11:
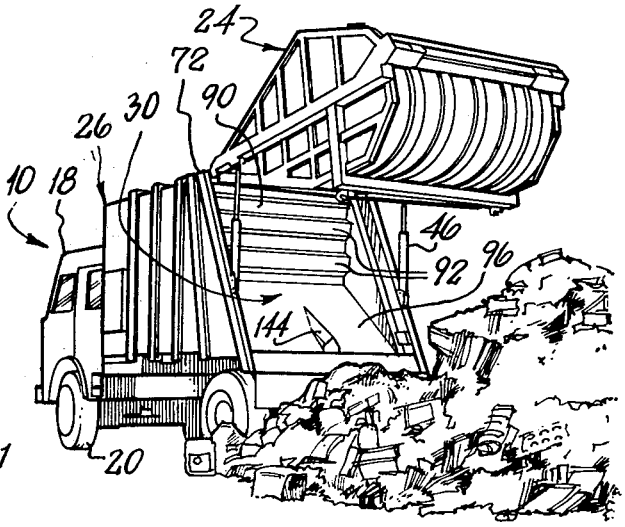
FIG. 11 shows a rear perspective view of the vehicle with its tailgate raised and showing the refuse pushing member in its rearmost position after discharging refuse.

Tailgate 24 has a large rectangular rear opening 42 to receive refuse and is mounted at its upper end by pivots 44 on container 26 for pivotal movement by a pair of hydraulic lift rams 46 from its working position shown in FIGS. 1 and 2 to a raised discharge position shown in FIG. 11.

Packing mechanism 28 comprises a packer plate 48, a sweeper plate 50 and respective pairs of hydraulic rams 52 and 54 connected to a pump (not shown) driven by the vehicle engine. Packer plate 48 is slidably mounted in linear guides 56 in the tailgate sidewalls for movement over a fixed plate 58 under the control of packer rams 52. Sweeper plate 50 is pivotally mounted on the rear end of packer plate 48 for limited angular movement under the control of sweeper rams 54. A hydraulic control mechanism (not shown) is provided to sequentially operate rams 52 and 54 to cause the packer and sweeper plates to carry out the sequence of operations shown in FIGS. 12 to 20 whereby refuse 60 deposited in tailgate 24 is packed into container 26 against refuse pushing member 30. The sequence of operations is initiated by a push button control 62 at the rear of the tailgate and is advanced by micro switches (not shown) operating solenoid-controlled hydraulic valves.

Refuse container 26 is in the form of an open-ended rectangular section body having high tensile steel side walls 64, a top wall 66 and a bottom wall 68, all braced by pressed steel channels 70 each extending completely around the container.

The open rear or discharge end 34 of container 26 is defined by a rigid rectangular frame comprising high tensile lateral girders 72 and fabricated top and bottom beams 74 to support tailgate 24. A maintenance access door 76 is provided at one side of the container.

Refuse pushing member 30 is seen in FIGS. 1, 3, 10 and 11 and is a rigid structure fabricated from high tensile steel and comprises a substantially vertical upper portion 78, a hollow lower portion 80 sloping downwards and towards the discharge end 34 of refuse container 26 from the lower edge of upper portion 78, and side walls 82 stiffened by respective A-frames 84. At the lower end of each A-frame is a channel section guide 86 to receive a longitudinal guide rail 87 secured one to each of the side walls 64 of refuse container 26 just above bottom wall 68, whereby the refuse pushing member 30 smoothly slides lengthwise of the container. Guides 86 are braced by respective hollow fabricated wedge-shaped supports 88.

Upper portion 78 of refuse pushing member 30 comprises a flat vertical plate 90 stiffened by three horizontal channel section members 92 at its rear side.

The hollow lower portion 80 of refuse pushing member 30 is generally triangular in section (as viewed in FIG. 1) comprising upwardly converging front and rear plates 94, 96 respectively, a base plate 98 and internal stiffening plates (not shown). A central channel 100, facing the non-discharge end 32 of container 26, is formed in lower portion 80 of refuse pushing member 30 to receive refuse pushing ram 36.

Support frame 38 and cantilever 40 are seen in FIGS. 1 and 3 to 9. Frame 38, which is positioned below refuse container 26, comprises two main support beams 102, 104 formed of rolled steel channel and extending lengthwise of refuse container 26, which are secured to vehicle frame 16.

The pressed steel channels 70 which brace refuse container 26 form, at the underside of the container, an integral part of frame 38. Thus the horizontal lower portion of each channel 70 comprises a center section 106 and two side sections 108, 110 welded to beams 102, 104 to form a rectangular framework therewith. Likewise, bottom wall 68 of container 26, which is welded to frame 38, is formed in three sections 112, 114 and 116 of which the side sections 114 and 116 have upturned flanges 118 at their outer edges.

Cantilever 40 is secured to beams 102 and 104 of frame 38 at the non-discharge end 32 of refuse container 26, extending upwards from the frame and forming therewith a rigid load-resisting structure. The cantilever is positioned (see FIG. 1) immediately behind driver's cab 18.

Figure 7:
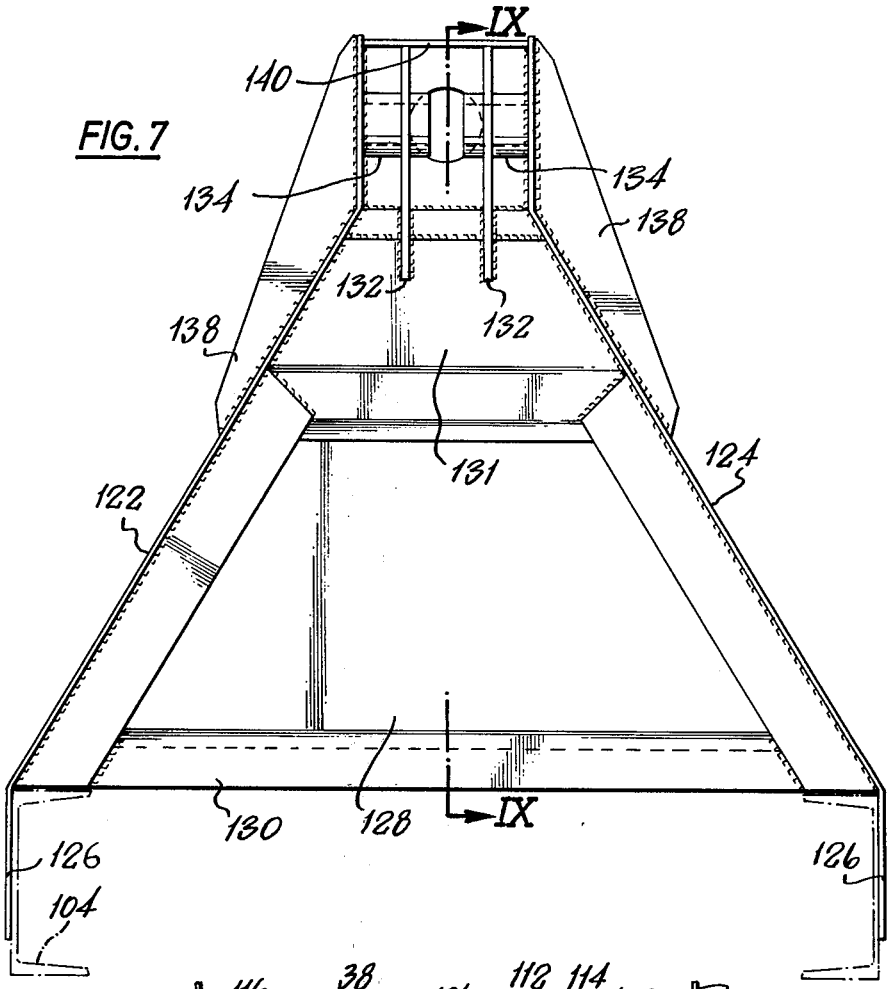
FIG. 7 shows a rear elevation view (arrow VII) of a cantilever seen in FIG. 4.
Figure 6:
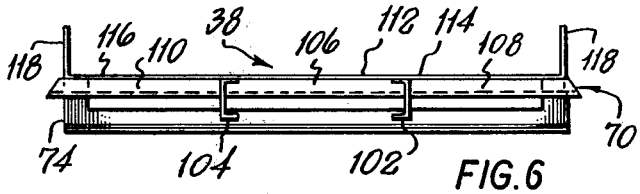
FIG. 6 shows a section (arrows VI—VI) through the assembly of FIG. 4.
Figure 4:
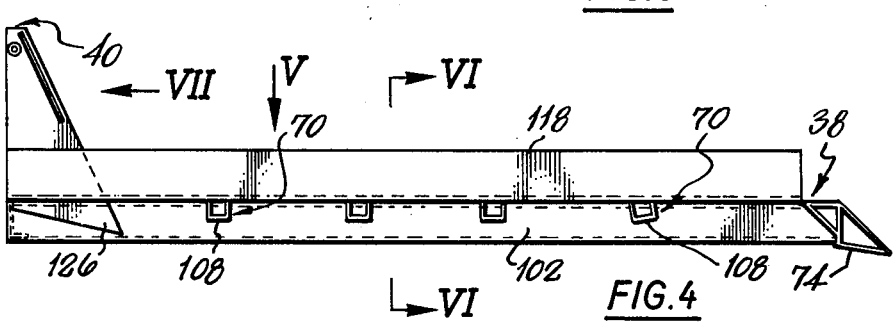
FIG. 4 shows, in a side elevation view similar to that of FIG. 1, a support frame and an associated cantilever forming part of the vehicle of FIG. 1.
Figure 12:
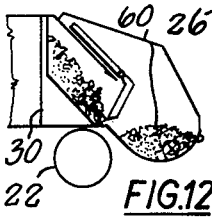
FIGS. 12 to 16 show diagrammatically, five successive stages in the operation of a hydraulic packer mechanism in the tailgate.
Figure 13:
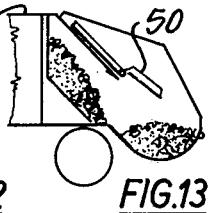
Figure 14:
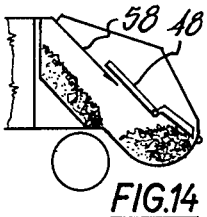
Figure 15:
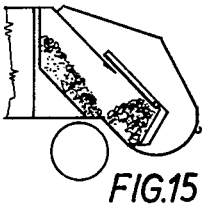
Figure 16:
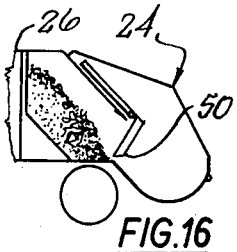
Figure 9:
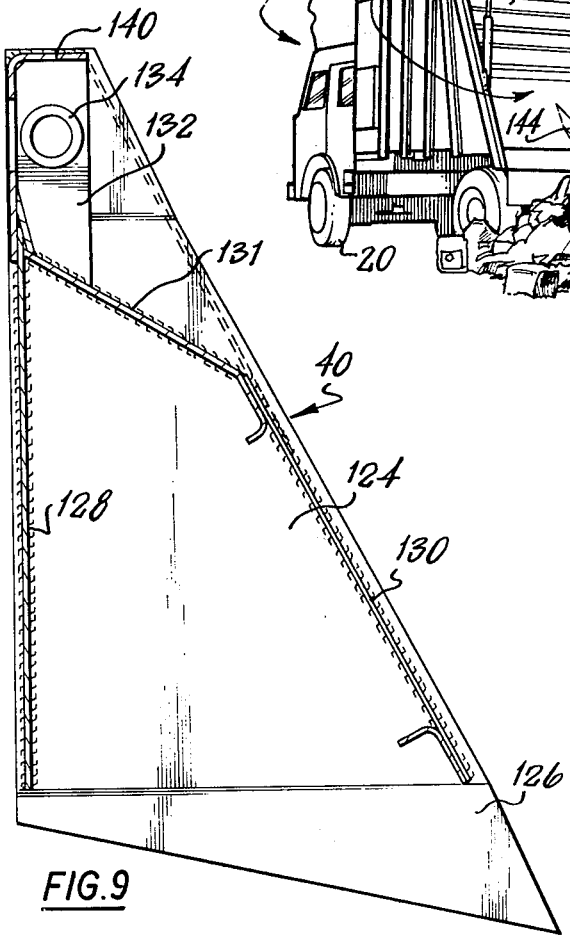
FIG. 9 shows a section on the center line (arrows IX—IX) of the cantilever seen in FIG. 7.

The details of the structure of cantilever 40 are best seen in FIGS. 7, 8 and 9. It is a rigid hollow fabricated steel structure which tapers upwardly from support frame 38 to provide a strong mounting for a connection 120 to refuse pushing ram 36.

Upwardly converging side plates 122, 124 provide at their lower edges a pair of downwardly extending flanges 126 which are welded to beams 102, 104 (see FIG. 7). A flat front plate 128, a rear frame 130, and an inclined plate 131 form, with side plates 122, 124, the main structural items of cantilever 40.

Ram connection 120 comprises a pair of parallel mounting plates 132 welded to inclined plate 131 and apertured and provided with sleeves 134 to receive a connecting pin 136. Mounting plates 132 are braced by a pair of flanges 138 and a horizontal top plate 140.

Refuse pushing ram 36 is connected by pin 136 at its front end to the upper end of cantilever 40, and extends downwardly and towards discharge end 34 of container 36 and is connected in a similar way by a connection 142 to refuse pushing member 30 at the rearmost end of channel 100. A small roof-shaped housing 144 is provided to cover and protect connection 142. Ram 36 itself is a three stage (or draw) double-acting telescopic ram.

As shown in FIG. 1, when ram 36 is retracted to bring refuse pushing member 30 to the non-discharge end 32 of container 26, member 30 overlies substantially the entire cantilever 40, which is located within the recess in front of sloping wall 94 of member 30, and between wedge shaped supports 88 (FIG. 10). In this position, upper wall portion 78 of refuse pushing member 30 is located substantially directly above connection 120 of ram 36 to cantilever 40 i.e. within 10 centimeters of a vertical line through connection 120.

Thus, in the fully forward position of refuse pushing member 30, container 26 can be packed with refuse by packer mechanism 28 right to the front end of the container so that no otherwise available refuse storage space is taken up by the load transmitting structures associated with refuse pushing ram 36. Cantilever 40, effectively occupies no refuse storage space.

Moreover, connection 120 between ram 36 and cantilever 40 is well below the halfway position between the level 146 of the top and the level 148 of the bottom of refuse pushing member 30 (and of container 26) and thus refuse is able to reach the front end of container 26 not just near the top of the container, but over at least half the depth of it.

In use, when container 26 is full, tailgate 24 is raised and ram 36 is extended to push refuse out of the discharge end 34 of container 26 as shown in FIG. 11. After lowering the tailgate (and locking it in position) refuse is deposited in the tailgate and is packed by mechanism 28 into container 26. Refuse pushing member 30 is automatically sequenced forwards in stages to provide substantially uniform compaction of refuse throughout the container filling process.

All reaction forces arising from extension and retraction of ram 36 are transmitted direct to cantilever 40 and frame 38 so that container 26 is substantially unstressed by these forces and can be of a relatively light construction. Moreover, frame 38 gives the refuse storage and discharge apparatus 14 great structural integrity and makes it a simple matter to fit the apparatus onto a wide variety of suitable road vehicle chassis.

We claim:

1. Refuse storage and discharge apparatus comprising a refuse container having a discharge end and a non-discharge end, an upright refuse pushing member to push refuse out of the discharge end of the refuse container, said refuse pushing member being mounted in the refuse container for movement lengthwise of the container, a support frame positioned below the refuse container and extending lengthwise of the refuse container, a cantilever secured to the support frame at the non discharge end of the refuse container, said cantilever extending upwards from the support frame and forming a rigid load-resisting structure therewith, said refuse pushing member comprising a substantially vertical upper wall portion from the lower edge of which a lower portion slopes downwards and towards the discharge end of said refuse container, said lower portion being constructed so as to overlie at least part of the cantilever when the refuse pushing member is at the non discharge end of the refuse container, and a hydraulic refuse pushing ram connected between the upper end of said cantilever and a lower portion of the refuse pushing member, the ram extending downwardly from the cantilever and towards the discharge end of the refuse container, the position of the connection between the ram and the cantilever being not higher than halfway between the top and the bottom of said refuse pushing member, said upper wall portion of the refuse pushing member being located substantially directly above said connection when the refuse pushing ram is fully retracted.

2. The refuse storage and discharge apparatus of claim 1 wherein said refuse pushing member comprises a rigid hollow fabricated steel structure having formed therein a channel facing the non discharge end of the refuse container, to receive the refuse pushing ram.

3. The apparatus of claim 1 in combination with a self propelled non-articulated road vehicle chassis, said apparatus being mounted on said chassis to form a rear discharge refuse collecting vehicle, said vehicle further comprising:

a tailgate to receive refuse;

the tailgate being pivotally mounted on said refuse container at the rear of the container and provided with hydraulic rams to lift the tailgate for the discharge of refuse;

a hydraulically operated packing mechanism in the tailgate to pack into said refuse container the refuse received by the tailgate;

a driver's cab mounted on said vehicle chassis immediately in front of said refuse container with said cantilever being positioned immediately behind the cab; and said cantilever comprising a rigid hollow fabricated steel structure which tapers upwardly from said support frame.

4. The vehicle of claim 3 wherein said cantilever has a pair of downwardly extending flanges rigidly secured to respective main support beams of said support frame, the support beams extending lengthwise of the refuse container.

* * * * *